US006422340B1

(12) United States Patent
Grundler

(10) Patent No.: US 6,422,340 B1
(45) Date of Patent: Jul. 23, 2002

(54) MARINE LADDER

(76) Inventor: Helmut Grundler, 1939 NW. 104th Ave., Coral Springs, FL (US) 33071

( * ) Notice: Subject to any disclaimer, the term of this patent is extended or adjusted under 35 U.S.C. 154(b) by 0 days.

(21) Appl. No.: 09/422,394

(22) Filed: Oct. 21, 1999

Related U.S. Application Data

(60) Provisional application No. 60/106,164, filed on Oct. 29, 1998.

(51) Int. Cl.[7] ..... E04G 3/00; E06C 7/06

(52) U.S. Cl. ..... 182/84; 182/209

(58) Field of Search ..... 182/84, 85, 88, 182/106, 127, 131, 206, 207, 209, 90, 91, 93

(56) References Cited

U.S. PATENT DOCUMENTS 3,452,838 A * 7/1969 Gabrielson et al. ..... 182/206 X
3,454,135 A * 7/1969 Redman et al. ..... 182/209
5,024,291 A * 6/1991 Price ..... 182/85
5,033,582 A * 7/1991 Hoben ..... 182/106
5,064,022 A * 11/1991 Graham ..... 182/93 X
5,282,339 A * 2/1994 Devlin et al. ..... 182/106 X
5,758,745 A * 6/1998 Beggs et al. ..... 182/207
5,931,258 A * 8/1999 Lorentz ..... 182/93
5,971,105 A * 10/1999 Jacobson ..... 182/93 X
6,092,624 A * 7/2000 Slater ..... 182/206 X

* cited by examiner

*Primary Examiner*—Daniel P. Stodola
*Assistant Examiner*—Hugh B. Thompson
(74) *Attorney, Agent, or Firm*—Cohen, Pontani, Lieberman & Pavane

(57) ABSTRACT

A marine ladder includes a catch mechanism in which a catch tyne is directly secured to the marine ladder without the need for additional structural members or support. The catch tyne is formed as a substantially L-shaped member that dependingly connects to a transverse bar on the dock-anchored frame of the ladder and defines a channel for receiving a leg of a user-selected one of the un-shaped rungs on an elongated ladder portion. The ladder portion is slidably engageable with and along the anchored frame to thereby selectively adjust the height of the ladder and thereby accommodate ready movement of persons between a dock and a proximate watercraft disposed at relatively different elevations.

14 Claims, 5 Drawing Sheets

MARINE LADDER

RELATED APPLICATIONS

This application claims priority under 35 U. S. C. §119 from U.S. Provisional Application Ser. No. 60/106,164, titled MARINE LADDER, filed Oct. 29, 1998.

BACKGROUND OF THE INVENTION

1. Field of the Invention

This invention relates generally to improvements in ladders. More specifically, the invention is directed to improvements in marine ladders wherein a support frame for the ladder safely secures a ladder portion thereto, and wherein catch mechanisms for the ladders are constructed to be permanently affixed to the ladders.

2. Description of the Related Art

The recreational and competitive sport of boating requires mastery of many land and sea-based maneuvers to safely operate a boat. One such needed maneuver arises in connection with boarding and debarking the boat from or to a stationary or floating dock. Typically, marine ladders have been used to load and unload the boat's crew and passengers. Prior marine ladders generally comprise a support frame that is fixedly mounted to the dock, and a ladder portion which slidably engages with the support frame so that the ladder portion can be adjusted to a desired height for use. The underside rungs of the ladder portion are u-shaped and so engage with a catch mechanism on the support frame to secure the ladder portion to the support frame after the desired height has been set.

The construction of the support frame and catch mechanism of prior art marine ladders has caused a great deal of problems in the past. The catch mechanism in prior art marine ladders is formed from a transverse bar that is surface welded at either of its ends to two upright or vertical support rods that are ultimately secured to the dock. FIGS. 7 and 8 illustrate this arrangement. The catch mechanism 10 comprises a catch tyne 20 which is integrally formed, such as by welding or metal bending, with transverse bar 30. On either end of transverse bar 30 is mounted a triangular shaped gusset 40 which extends downward from the underside of bar 30. Gussets 40 are surface welded to the vertical support rods 50 to further secure the catch mechanism 10 to the vertical support rods 50.

The problem which arises from this arrangement is that the gussets 40 are subjected to severe strains from use, weather and the harsh conditions found at and around salty ocean water, lakes and other bodies of water. Since the gussets 40 are separate structures which are merely surface welded to the support rods 50 and transverse bar 30, the joints 60 between the gussets 40, support rods 50, and transverse bar 30, defined by the welds, form weak areas on the marine ladder and quickly degrade and sometimes fracture due to the stresses placed on the catch tyne 20 when users employ the marine ladder to get in to and out of the boat from or to the dock. Furthermore, the deleterious effects of weather and corrosion attack the joints 60. Within a relatively short amount of time, the joints 60 decay and the catch mechanism 10 detaches from the support rods 50 and/or the transverse bar 30. This result is a dangerous situation which makes boating unsafe, and can cause severe injuries to individuals using such prior art marine ladders.

There accordingly exists a long-felt need in the art for marine ladders which safely and effectively allow boaters to climb in to and out of boats from or to docks over long or extended periods of time. Prior art marine ladders do not satisfy this long felt need.

SUMMARY OF THE INVENTION

The aforementioned long-felt needs are met, and problems solved, by marine ladders having secure catch and securement mechanisms provided in accordance with the present invention. The inventive marine ladders include a catch mechanism that is adapted to engage the underside of rungs of a relatively movable ladder portion to secure the ladder portion to the support frame when the marine ladder is being used. The catch mechanism preferably comprises a transverse bar having at least one catching tyne. The transverse bar is secured at its two ends to vertical support rods of a support frame for the ladder. At least one catch tyne is fixedly secured to the transverse bar and is not subject to loosening or detachment therefrom. Preferably, the tyne is directly affixed to the transverse bar without the use of gussets or any other external members or elements that may require a separate means of securment, as for example by welding.

The catch tyne is secured to the transverse bar by any number of securing devices, such for example as screws, rivets, and pins. Additionally, the catch tyne may be further secured to the transverse bar by a watertight and impermeable adhesive that is not subject to degradation due to weather or the difficult environment typically imposed on marine ladders from salt water, lakes and river bodies containing minerals and other contaminants. Even more preferably, the support frames comprise guide members that engage the support rods of the ladder portions to allow for smooth and safe adjustment of the height of the ladder portions. Still more preferably a set of stop members is disposed on the vertical support members of the ladder portion for setting the maximum height allowed by the ladder portion and for relieving undo stresses on the catch tyne.

Marine ladders of the present invention ensure safe loading and unloading of boat passengers and crews to and from dock areas. The inventive marine ladders are of simple construction and are economical to manufacture. Such results have not heretofore been achieved in the marine ladder art.

These and other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote like elements throughout the several views.

DESCRIPTION DETAILED OF THE PREFERRED EMBODIMENTS

Figure 1:
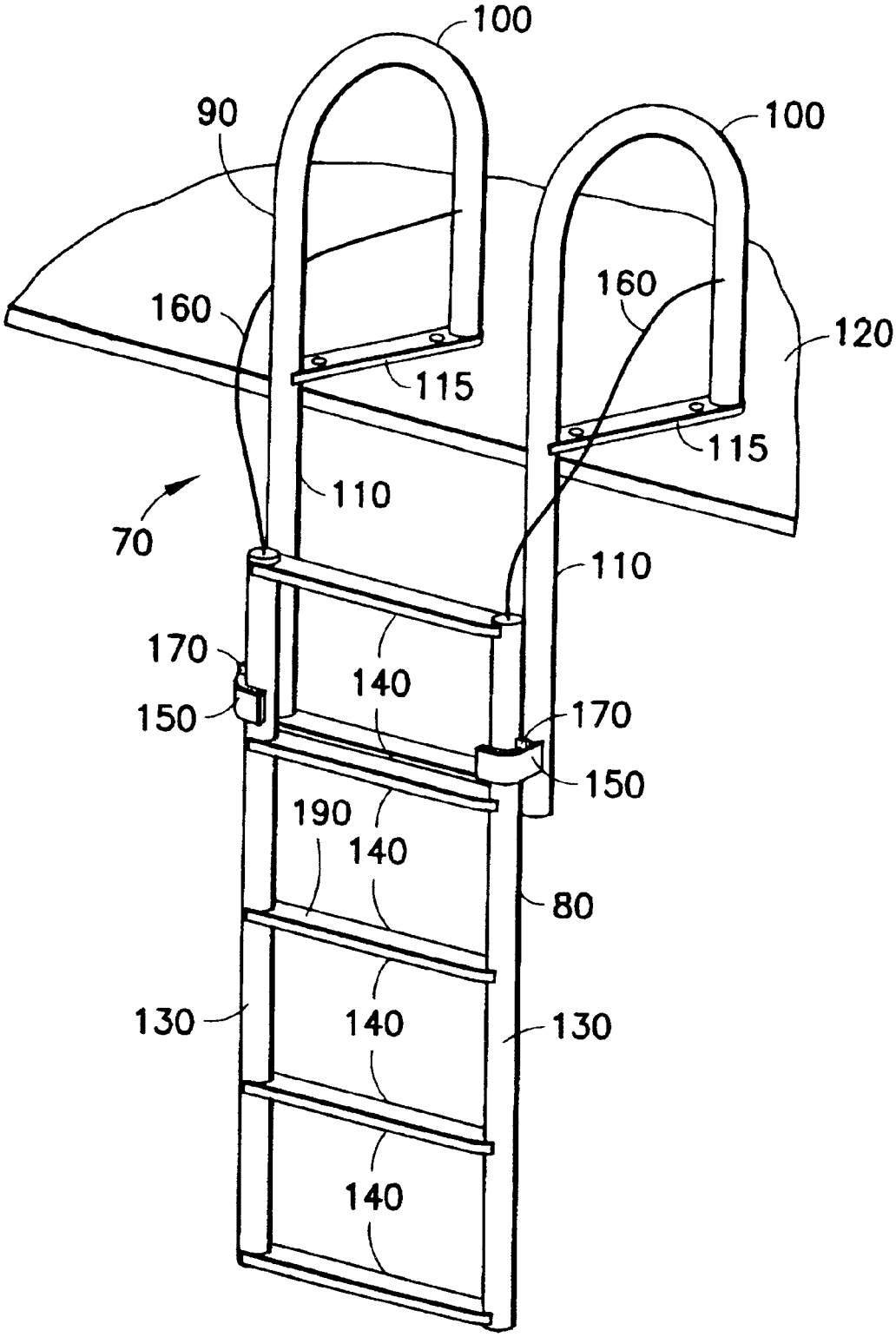
FIG. 1 is a perspective view of a marine ladder of the present invention secured to a dock and having a relatively movable ladder portion in a maximum extended height position.
Figure 2:
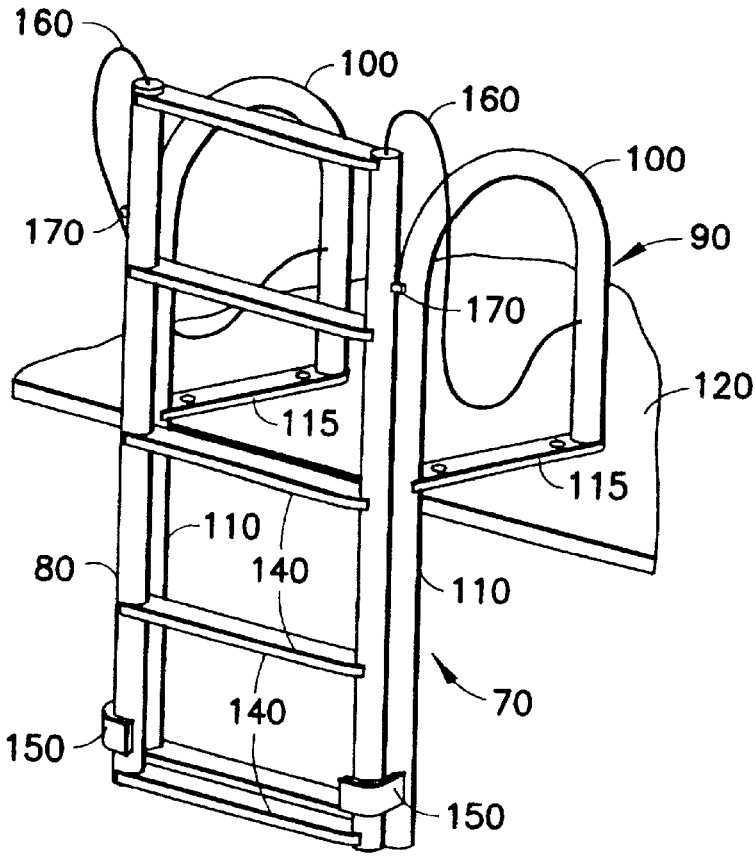
FIG. 2 is a perspective view of the marine ladder of FIG. 1 wherein the ladder portion is in a minimum extended height position.
Figure 6:
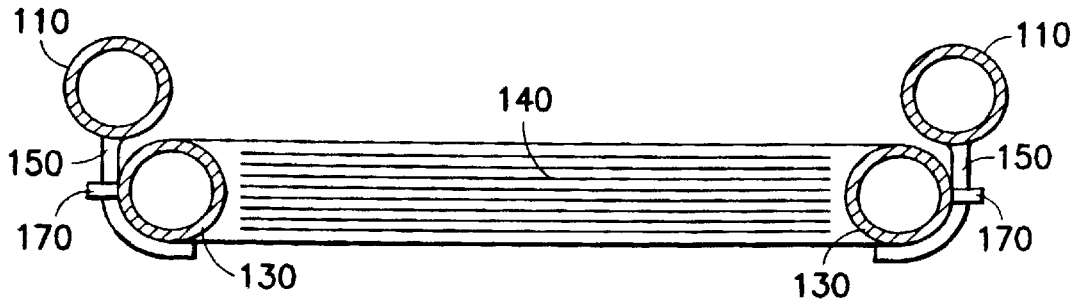
FIG. 6 is a top plan view of a marine ladder in accordance with the present invention.
Figure 7:
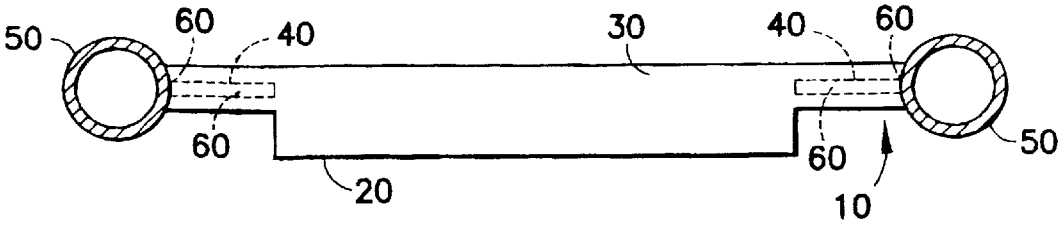
FIG.7 PRIOR ART
FIG. 7 is a top plan view of a prior art marine ladder.
Figure 8:
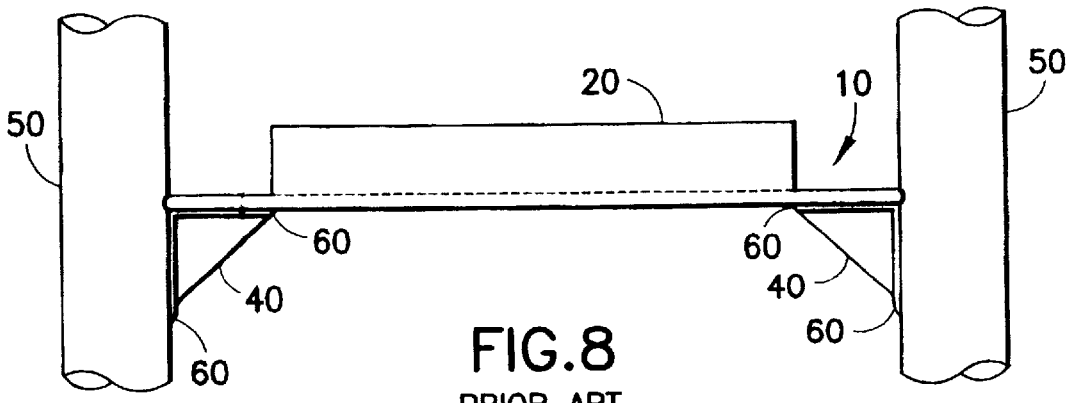
FIG.8 PRIOR ART
FIG. 8 is a front view of a portion of the marine ladder of FIG. 7.

Referring initially to FIGS. 1, 2 and 6, by way of preferred and illustrative example, a marine ladder of the present invention is shown generally at 70. While the invention is described herein with respect to a marine ladder, it will be appreciated by those skilled in the art that any type of adjustable height ladder may employ the inventive concepts taught and disclosed throughout, and that the invention is therefore not limited to marine ladders. Preferably, the marine ladder 70 comprises a selectively movable ladder portion 80 that is slidably engaged or engagable with a fixed support frame 90. The support frame 90 more preferably comprises a pair of unshaped, substantially parallel, vertical support rods 100 each having a vertical support portion 110 that extend in substantially parallel fashion down from the u-shaped portions. The u-shaped portions are each secured to a tie-down member 115. The tie-down members 115 are spaced at a first fixed distance apart and are securely affixed for use to a surface of a dock, shown generally at 120. The vertical support portions 110 preferably extend a suitable distance below the surface of dock 120 to which the tie-down members 115 are secured.

The ladder portion 80 preferably comprises a substantially rectangular frame formed by two substantially parallel, vertical support members 130 and a plurality of cross-sectionally u-shaped rungs 140 that define a channel on the undersides thereof to engage the support frames on catching mechanisms to be described in detail hereinbelow. The vertical support members 130 are still more preferably spaced a second fixed distance apart, typically the length of rungs 140, wherein the second fixed distance is slightly less than the first fixed distance. Although u-shaped rungs having a flat footrest portion (on which a user stands in normal use of the ladder) and a pair of depending legs extending downwardly (in use) from the footrest portion are herein shown and described and are most common in the ladder art, other rung structures and configurations may alternatively be employed. The only requirement in this regard is that each rung have, or be associated with, a projection or member or surface for engagement with the catch mechanism of the invention and, as most preferred and herein disclosed by way of preferred examples, for supported receipt in the channel defined in the catch tyne of the invention as hereinafter described.

Support members 130 are operable to engage a set of guide members 150 that are integrally formed, as for example by welding, on vertical support portions 110 and which allow the support members 130 to slide therein without moving or slipping laterally away from support frame 90. In this manner, the height of ladder portion 80 can be readily adjusted from the maximum height as shown in FIG. 1 to the minimum height as shown in FIG. 2. The desired height is set by pulling on optional flexible wires or lines 160 and resting the desired rung 140 supportedly on the catch mechanism at the underside channel of the rung. The maximum height of the marine ladder is governed by a pair of stop members 170 fixed to one or both of the vertical rod members 130 of ladder portion 80 between the first topmost and second topmost rungs thereof.

Figure 3:
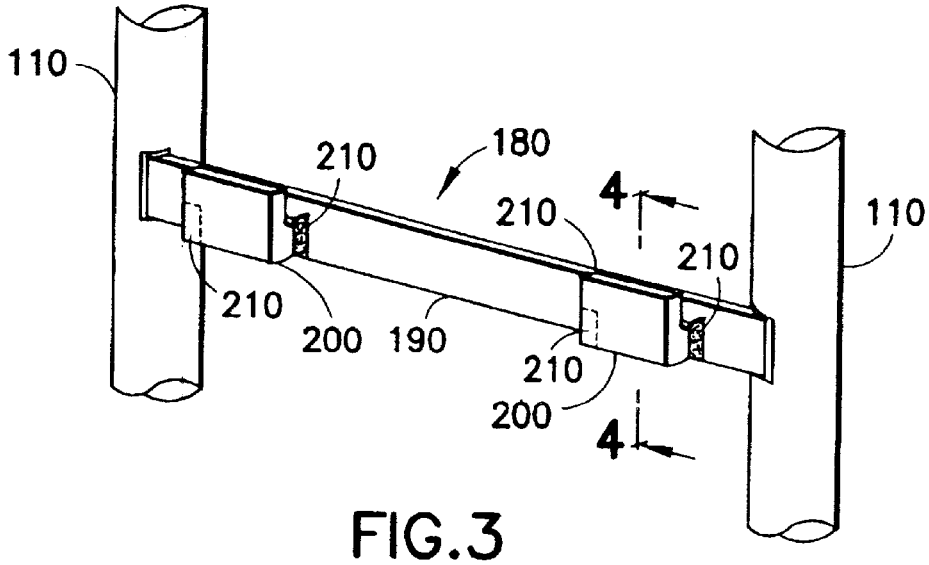
FIG. 3 is a perspective view of a catch mechanism for a marine ladder in accordance with the present invention.

Referring now to FIG. 3, a preferred catch mechanism of the present invention is illustrated at 180. The catch mechanism preferably comprises a transverse bar 190 of substantially the first fixed distance in length. The transverse bar 190 is securely fixed at each of its ends to the respective vertical support portion 110 of the frame 90. Transverse bar 190 is preferably affixed to the vertical support portions 110 by welding, although other suitable types of affixation will be apparent to those skilled in the art such as, without limitation, rivets, nuts and bolts and adhesives.

In accordance with the invention, at least one catch tyne 200 is directly affixed to or integrally formed with transverse bar 190. The catch tyne 200 is preferably substantially L-shaped and does not require any gussets or separate securing mechanisms to affix it to the transverse bar 190. Additionally, in a preferred aspect of the invention, catch tyne 200 is not itself secured to the vertical support portions 110. In this manner, the catch tyne 200 is not subject to breaking away or disconnection from transverse bar 190 due to undue stress from the weight of persons or users climbing on the marine ladder, or corrosion and weather damage which tends to loosen prior art catch mechanisms from marine ladders as discussed above. In the embodiment shown in FIG. 3, two catch tynes 200 are affixed in spaced apart relation to the transverse bar 190. However, it will be further appreciated by those skilled in the art that any number of catch tynes of varying lengths and/or dimensions may be employed in accordance with the invention.

In the embodiment of FIG. 3, the two catch tynes 200 are spot welded to the surface of transverse bar 190 to form joints 210 on both ends and along the horizontal extent between the ends of the L-shaped member of the catch tynes 200. Since no separate structure is employed to generally secure the catch tynes to the catch mechanism, the joints 210 are inherently stronger than those found in prior art catch mechanisms and will not degrade or lessen the associated structural integrity.

Figure 4:
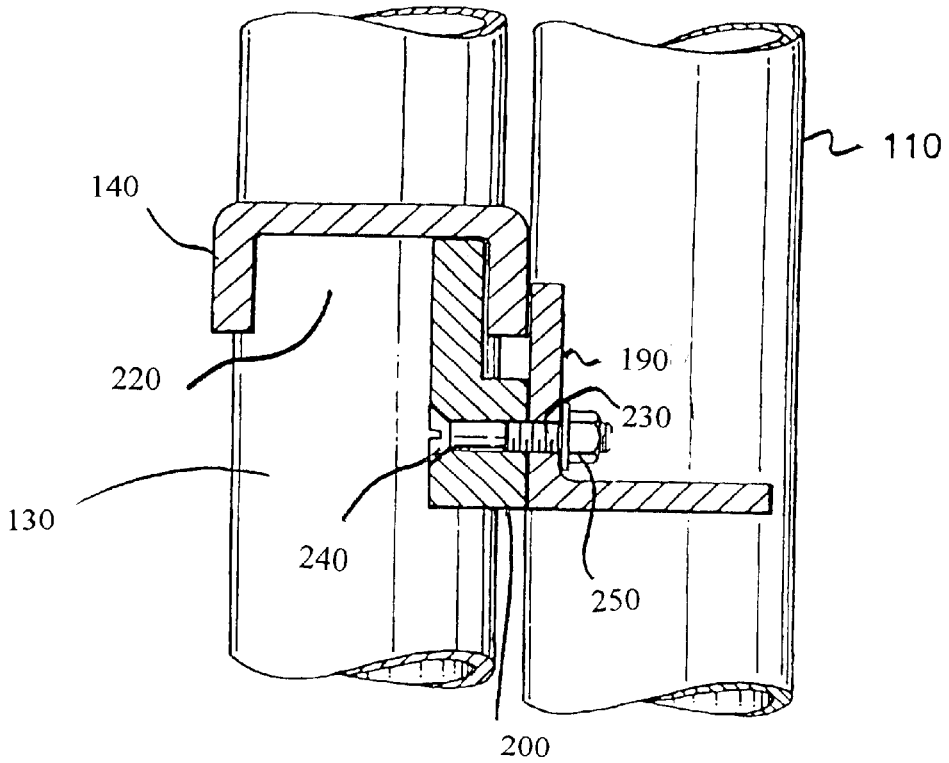
FIG. 4 is a cross-sectional view of the catch mechanism of FIG. 3 taken along the lines 4—4 thereof.

FIG. 4 illustrates the manner in which the catch tyne 200 of the present invention operatively engages a unshaped channel 220 of rung 140 to secure the ladder portion 80 to the support frame 90. As seen in this Figure, the upright, vertical portion of L-shaped catch tyne 200 engages unshaped channel 220 to secure rung 140 therein. In a further preferred aspect of the invention, catch tyne 200 is securely affixed to transverse bar 190 with a mating screw and nut combination, shown generally at 230. The shaft of a screw 240 is journaled through a hole drilled or otherwise machined in catch tyne 200. Another hole is similarly drilled or machined through transverse bar 190 for securing the screw shaft and the screw is secured in position by a threaded nut 250.

Figure 5A:
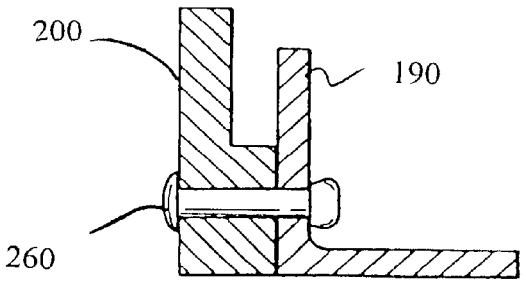
FIGS. 5*a* and 5*b* are cross-sectional views of catch mechanisms in accordance with the present invention showing alternative arrangements for securing the catch tyne to the transverse bar.
Figure 5B:
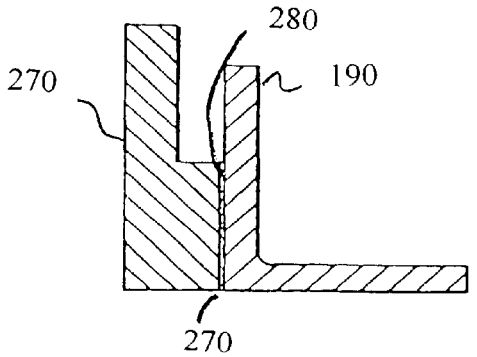

FIGS. 5*a* and 5*b* illustrate yet alternative arrangements for securing the catch tyne 200 to transverse bar 190. In FIG. 5*a*, a rivet 260 secures the catch tyne 200 to the transverse bar 190. FIG. 5*b* illustrates the use of a water impermeable adhesive for securing the catch tyne to the transverse bar. By placing an adhesive on the outside face 270 of catch tyne 200, a substantially water-tight seal 280 is created between the outside face 200 and the transverse bar 190 to securely and permanently affix the catch tyne 200 to transverse bar 190. It will nevertheless be recognized by those skilled in the art that other methods of securing the catch tyne 200 to the transverse bar 190 are likewise within the scope of the present invention. Generally, all such methods will comprise direct securement of catch tyne 200 to transverse bar 190 without the need for separate structures which could result in a weakening between the joint or interface of the catch tyne and transverse bar.

Figure 9:
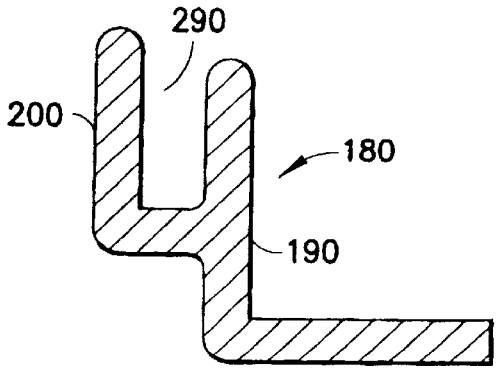
FIG. 9 is a cross-sectional view of an alternative embodiment of the catch mechanism of the present invention.
Figure 10:
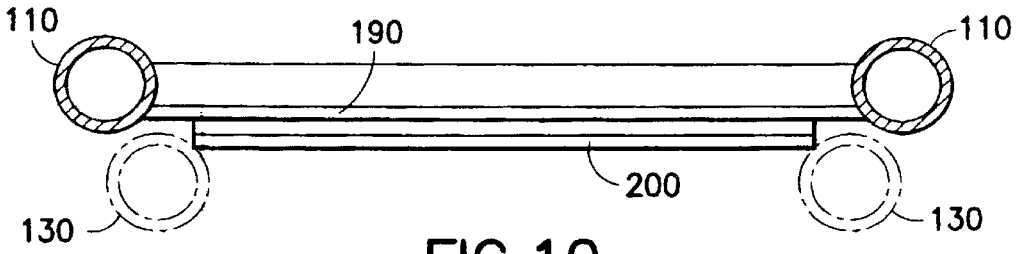
FIG. 10 is a top plan view of the catch mechanism of FIG. 9.
Figure 11:
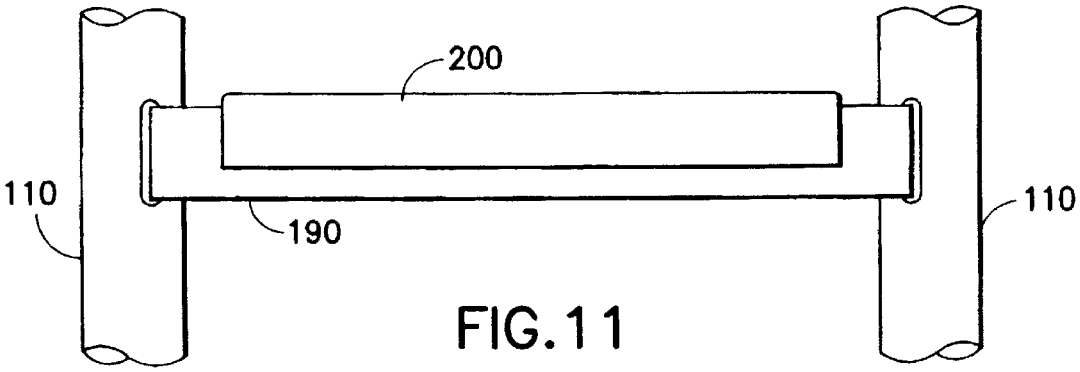
FIG. 11 is a front view of the catch mechanism of FIG. 9.

FIGS. 9, 10 and 11 illustrate yet another embodiment of a catch mechanism 180 in accordance with the present invention. In this further embodiment, catch tyne 200 is integrally or unitarily formed from or as a part of the same metal member, as for example an extruded aluminum member, as is the transverse bar 190. The L-shaped portions of the catch tyne 200 may also be formed by metal bending of the material to create a pronounced reciprocal u-shaped channel 290 for engagement with the u-shaped channel 220 of rung 140.

The marine ladders of the present invention are notably simple and straight forward to fabricate and are therefore advantageously economical to manufacture. Due to the effective ways in which the catch mechanisms taught herein are constructed, the inventive marine ladders are unusually safe and more reliable than prior art marine ladders. Such results have not heretofore been achieved in the art.

While there have been shown and described and pointed out novel features of the invention as applied to preferred embodiments thereof, it will be understood that various omissions and substitutions and changes in the devices shown and described herein, and in their operation, may be made by those skilled in the art without departing from the spirit and scope of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It should also be understood that the drawings are not necessarily drawn to scale but are merely conceptual in nature. It is the intention, therefore, to be limited only as indicated by the scope of the claims appended hereto.

What is claimed is:

1. In an adjustable height marine ladder which includes a moveable ladder portion slidably engaged with an anchored support frame having a pair of spaced apart support rods, the improvement comprising a catch mechanism operable to engage and retain a substantially u-shaped rung on the moveable ladder portion to adjustably fix the height of the ladder for use, said catch mechanism comprising:

an elongated transverse bar having longitudinally-opposite ends and a length defined between said opposite ends, said transverse bar being secured at said opposite ends to the spaced apart support rods of the anchored support frame for bearing weight of persons climbing and supported on the ladder; and a catch tyne having a channel and securely affixed directly to the transverse bar only at an abutment interface between the catch tyne and transverse bar, said catch tyne extending along the length of the transverse bar and terminating interior to said securement of the ends of the transverse bar to the spaced apart support rods of the support frame so that the catch tyne, in its affixation to the transverse bar, is independent of the spaced apart support rods of the anchored support frame, along a predeterminately sufficient portion of said transverse bar length so as to accommodate engagement of said catch tyne with a user-selected rung of the ladder portion for effecting user adjustment of the height of the ladder and support of the weight of persons climbing and supported on the ladder, wherein the catch tyne is configured for operative receipt, in the channel of the catch tyne, of a leg of the user-selected ladder rung in seated relation in said channel when the ladder portion is slidably adjusted to bring the user-selected ladder rung leg into seated engagement in said channel of the catch tyne to thereby support and retain the ladder portion at a user-selected elevation on and along the anchored support frame.

2. The marine ladder of claim 1, wherein the channeled catch tyne comprises an upright vertical portion and a horizontal portion connected to the upright vertical portion to boundingly define the channel in the catch tyne, wherein the catch tyne is connected to the transverse bar at said horizontal portion of the catch tyne.

3. The marine ladder of claim 2, wherein the catch tyne is connected to the transverse bar by a spot weld.

4. The marine ladder of claim 2, wherein the catch tyne is connected to the transverse bar by a nut and bolt arrangement.

5. The marine ladder of claim 2, wherein the catch tyne is connected to the transverse bar by a rivet.

6. The marine ladder of claim 2, wherein the catch tyne is connected to the transverse bar by an adhesive.

7. The marine ladder of claim 2, wherein the catch tyne is integrally connected to said transverse bar by unitarily extruding said transverse bar and catch tyne to form a unitary combined member.

8. The marine ladder of claim 1, wherein said catch tyne comprises a first portion and a second portion extending substantially transverse to said first portion, said second portion connecting said first portion to said transverse bar, wherein the material of the first portion is bent to create said channel.

9. An adjustable height marine ladder for supporting persons moving between a dock and a proximately-located watercraft respectively disposed at different relative elevations, comprising:

a support frame secureable to a dock to anchor the support frame to the dock, said support frame comprising a pair of substantially parallel elongated support rods spaced apart a first fixed distance and which, when the support frame is anchored to the dock, extend substantially vertically along the dock;

an elongated ladder portion slidably engagable with said support frame for longitudinal movement of the ladder portion relative to aid support frame along said support rods for user-selectable adjustment of the height of the marine ladder, said ladder portion comprising a plurality of rungs spaced longitudinally along said ladder portion for supporting persons climbing and standing on said rungs for movement between the dock and a proximate watercraft, each said rung comprising a footrest portion for supporting a person on said each rung and an engagement leg extending substantially along the elongation of said ladder portion;

a transverse bar having longitudinally-opposite ends and a length defined between said opposite ends, said transverse bar being fixedly secured at said opposite ends to and spanningly between the support rods of said support frame; and a catch tyne securely mounted directly to the transverse bar only at an abutment interface between the catch tyne and transverse bar and along a predeterminately sufficient portion of said transverse bar length so as to accommodate engagement of said catch tyne with the engagement leg of a user-selected rung of the ladder portion for user adjustment of the height of the ladder and to support the weight of persons climbing and supported on the ladder, wherein a channel is defined at least in part by said catch tyne, said catch tyne being configured for operative receipt in said channel of the engagement leg of the user-selected ladder rung in seated relation to said channel when the ladder portion is slidably adjusted to bring the user-selected ladder rung engagement leg into seated engagement in said channel to thereby support and retain the ladder portion at a user-selected elevation on and along the anchored support frame.

10. The marine ladder of claim 9, wherein said rungs of the ladder portion are substantially u-shaped in cross section and said engagement leg depends from said footrest portion of each said rung.

11. The marine ladder of claim 9, wherein said catch tyne comprises a first portion extending substantially along the elongation of said support rods and a second portion extending substantially transverse to said first portion, said second portion connecting said first portion to said transverse bar, wherein said channel is boundingly defined by said first portion, said second portion and said transverse bar.

12. The marine ladder of claim 11, wherein the second portion of said catch tyne is connected to said transverse bar by a spot weld.

13. The marine ladder of claim 11, wherein the second portion of said catch tyne is connected to said transverse bar by an adhesive.

14. The marine ladder of claim 9, wherein said catch tyne comprises a first portion extending substantially along the elongation of said support rods and a second portion extending substantially transverse to said first portion, said second portion connecting said first portion to said transverse bar, wherein the material of said first portion is bent to create said channel in a top of said elongation.

* * * * *